US009790045B2

(12) United States Patent
Perttilä

(10) Patent No.: US 9,790,045 B2
(45) Date of Patent: Oct. 17, 2017

(54) METHOD FOR THE OPTIMAL ALIGNMENT OF VENEER SHEETS AT A LAY-UP STATION

(75) Inventor: Marko Perttilä, Nastola (FI)

(73) Assignee: Raute Oyj, Nastola (FI)

( * ) Notice: Subject to any disclaimer, the term of this patent is extended or adjusted under 35 U.S.C. 154(b) by 986 days.

(21) Appl. No.: 12/877,291

(22) Filed: Sep. 8, 2010

(65) Prior Publication Data

US 2011/0057384 A1 Mar. 10, 2011

(30) Foreign Application Priority Data

Sep. 9, 2009 (FI) ..... 20095931

(51) Int. Cl.

| | |
|---|---|
| ***B65H 7/02*** | (2006.01) |
| ***B65H 9/10*** | (2006.01) |
| ***B65H 7/06*** | (2006.01) |
| ***B65H 29/34*** | (2006.01) |

(52) U.S. Cl.

CPC ..... *B65H 9/103* (2013.01); *B65H 7/06* (2013.01); *B65H 29/34* (2013.01); *B65H 2301/4213* (2013.01); *B65H 2301/4219* (2013.01); *B65H 2511/10* (2013.01); *B65H 2511/216* (2013.01); *B65H 2511/232* (2013.01); *B65H 2511/242* (2013.01); *B65H 2551/29* (2013.01); *B65H 2553/42* (2013.01); *B65H 2555/31* (2013.01); *B65H 2701/1938* (2013.01)

(58) Field of Classification Search

CPC ..... B65H 2553/40; B65H 2553/42; B65H 2551/29; B65H 2701/1938; B65H 2301/421; B65H 2301/423

USPC ..... 271/226–228

See application file for complete search history.

(56) References Cited

U.S. PATENT DOCUMENTS

| | | | | |
|---|---|---|---|---|
| 4,700,758 | A * | 10/1987 | Bernath | 144/118 |
| 4,794,963 | A * | 1/1989 | Oppeneer | 144/358 |
| 5,201,258 | A * | 4/1993 | Cremona | 83/75.5 |
| 5,984,301 | A * | 11/1999 | Holbert et al. | 271/227 |
| 2003/0173734 | A1 | 9/2003 | Wong et al. | |

FOREIGN PATENT DOCUMENTS

| | | |
|---|---|---|
| JP | 2000-6112 | 1/2000 |

* cited by examiner

*Primary Examiner* — Howard Sanders

(74) *Attorney, Agent, or Firm* — Womble Carlyle Sandridge & Rice LLP

(57) ABSTRACT

The invention relates to a method for the optimal positioning of veneer sheets at a lay-up station, wherein the veneer sheets are attached for a veneer assembly composed of veneer sheets glued on top of each other. The method comprises determining an optimal position for each veneer sheet and a location for virtual alignment edges and laying up the veneer sheets as positioned in accordance with the virtual alignment edges, for a veneer assembly.

6 Claims, 4 Drawing Sheets

METHOD FOR THE OPTIMAL ALIGNMENT OF VENEER SHEETS AT A LAY-UP STATION

CROSS-REFERENCE TO RELATED APPLICATION

This application claims priority from and the benefit under 35 U.S.C. §119 of Finnish Patent Application No. 20095931, filed Sep. 9, 2009 in the Finnish Patent Office, which is hereby incorporated herein by reference in its entirety.

FIELD OF THE DISCLOSURE

The present invention relates to a method for the optimal alignment of veneer sheets at a lay-up station, wherein the veneer sheets are laid up for a veneer assembly composed of veneer sheets glued on top of each other.

BACKGROUND OF THE DISCLOSURE

In the manufacture of plywood panels or laminated veneer lumber (LVL), the veneers are laid up at a lay-up station for a veneer assembly with a thickness of several veneer layers. Top surfaces of the veneers have adhesive applied thereto and the veneers are laid on top of each other and then, in the next working step, brought to a permanent attachment with each other by the application of pressure and heat. This calls for a precise alignment of veneers relative to each other. Traditionally, the alignment has been performed manually against two stationary fences. At present, the lay-up operation is often machine-operated, but two stationary fences are still involved one way or another. The manufacture of LVL has involved the use of a mechanical lay-up operation. However, the LVL is structurally different with its veneers supposedly parallel to each other. The application publication US 2003/0173734 describes one LVL manufacturing apparatus and method, enabling a precise alignment of veneer sheets relative to each other by adapting what in the advancing direction of a veneer sheet constitutes its leading edge to function as an alignment edge and by positioning the veneer sheets at a lay-up station on top of a two-segment tablet arrangement, said tablet segments being adapted to move towards and away from each other. In this solution, the identification of a leading edge position is used as a controlling parameter for the process. Still, even in this solution, the leading edge is identified by mechanical brackets in just two positions.

SUMMARY OF THE DISCLOSURE

An objective of the present invention is to provide an improved solution, enabling a better consideration of defects in veneer sheets for optimizing the position of alignment edges. In order to achieve this objective, a method according to the invention is characterized in that the method comprises determining an optimal position for each veneer sheet and virtual locations for alignment edges, and laying up the veneer sheets, as positioned in accordance with the virtual alignment edges, for a veneer assembly.

In the context of this application, the virtual alignment edge refers to an optimal location of alignment edges, said alignment edges being in a substantially perpendicular relationship with each other, considering e.g. defects in the immediate vicinity of a real veneer edge in such a way that the defects shall end up in a portion to be cut off in a subsequent operation and, on the other hand, in such a way that a maximal surface area of the veneers can be utilized. Defects can be e.g. in the form of a sizable knot hole, a split or cracked veneer portion, an edge waviness, etc. The alignment can also be conducted in a totally visual manner by using e.g. laser lines as an alignment edge. Once a veneer assembly has been composed of the veneers, the veneer assembly shall be conveyed to a trimming operation for the virtual alignment edge to become a real alignment edge in the trimming operation, and especially in such a way that the defects of intermediate veneers shall not be visible until after an edge sawing operation.

BRIEF DESCRIPTION OF THE DRAWINGS

The invention will now be described more closely with reference to the accompanying drawings, in which.

DETAILED DESCRIPTION OF THE DRAWINGS

Figure 1:
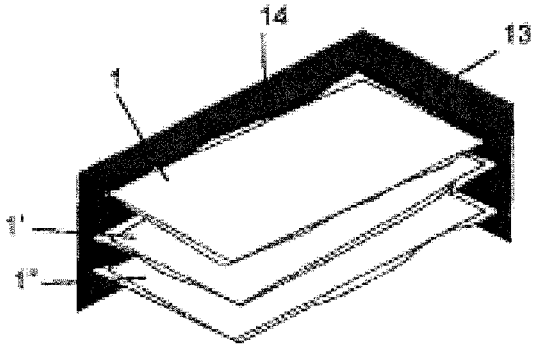
FIG. 1 shows a traditional lay-up practice in a schematic view of principle.

FIG. 1 depicts a traditional way of laying up veneer sheets, wherein veneer sheets 1, 1', 1" are aligned against stationary fences 13, 14 set in a perpendicular relationship with each other. This method has been in active service for a long time, but it has a problem in the sense that the veneers may end up in an undesirable position. In FIG. 1, the uppermost veneer 1 is shown in such incorrect position, the result of which is that the veneers must be sawn to a slight oversize in order to ensure a correct size for the veneer assembly after the edge sawing operation.

Figure 2:
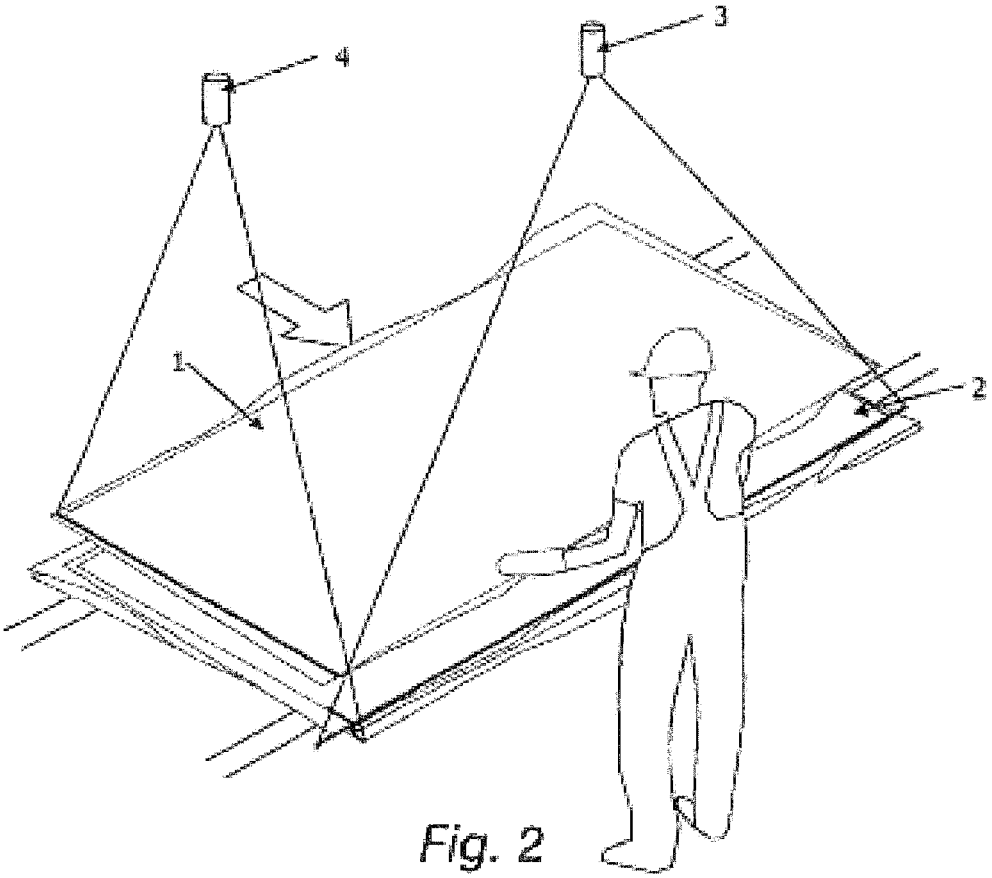
FIG. 2 shows in a schematic view of principle one lay-up practice implemented according to the present invention.

FIG. 2 shows a method of the invention, in which the laying up of veneers is conducted manually by using laser lines to indicate the location of a virtual alignment edge. Laser pointers 3, 4 produce two laser lines perpendicular to each other, which enable the operator to align a veneer 1 arriving at the lay-up operation on top of a most recently laid-up veneer 2 in an optimal manner. The operator aligns the veneer 1 in consideration of possible defects present in the leading edge closest to himself for making maximum use of the veneer in terms of its surface area.

Figure 3:
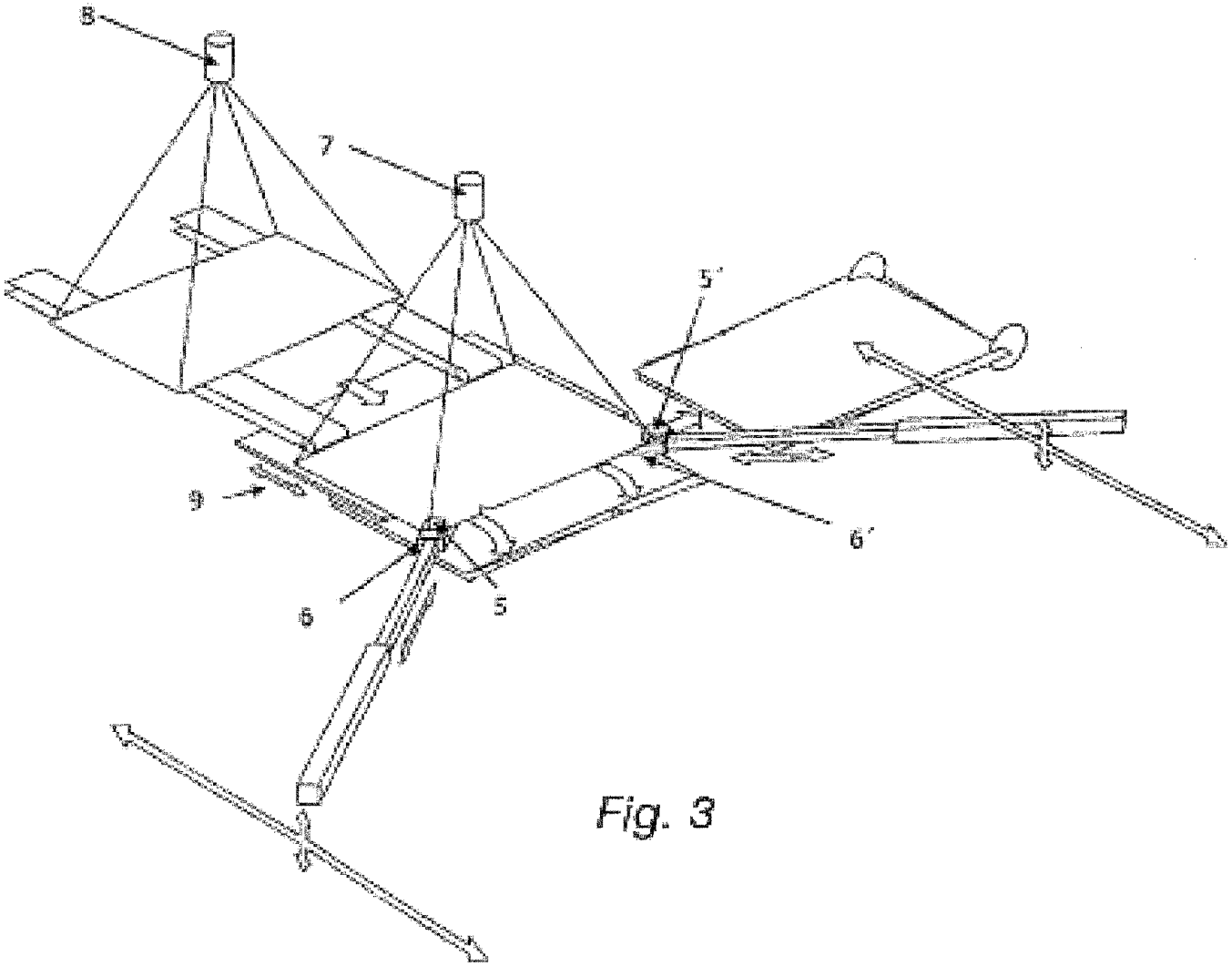
FIG. 3 shows in a schematic view of principle a second lay-up practice implemented according to the present invention.
Figure 4:
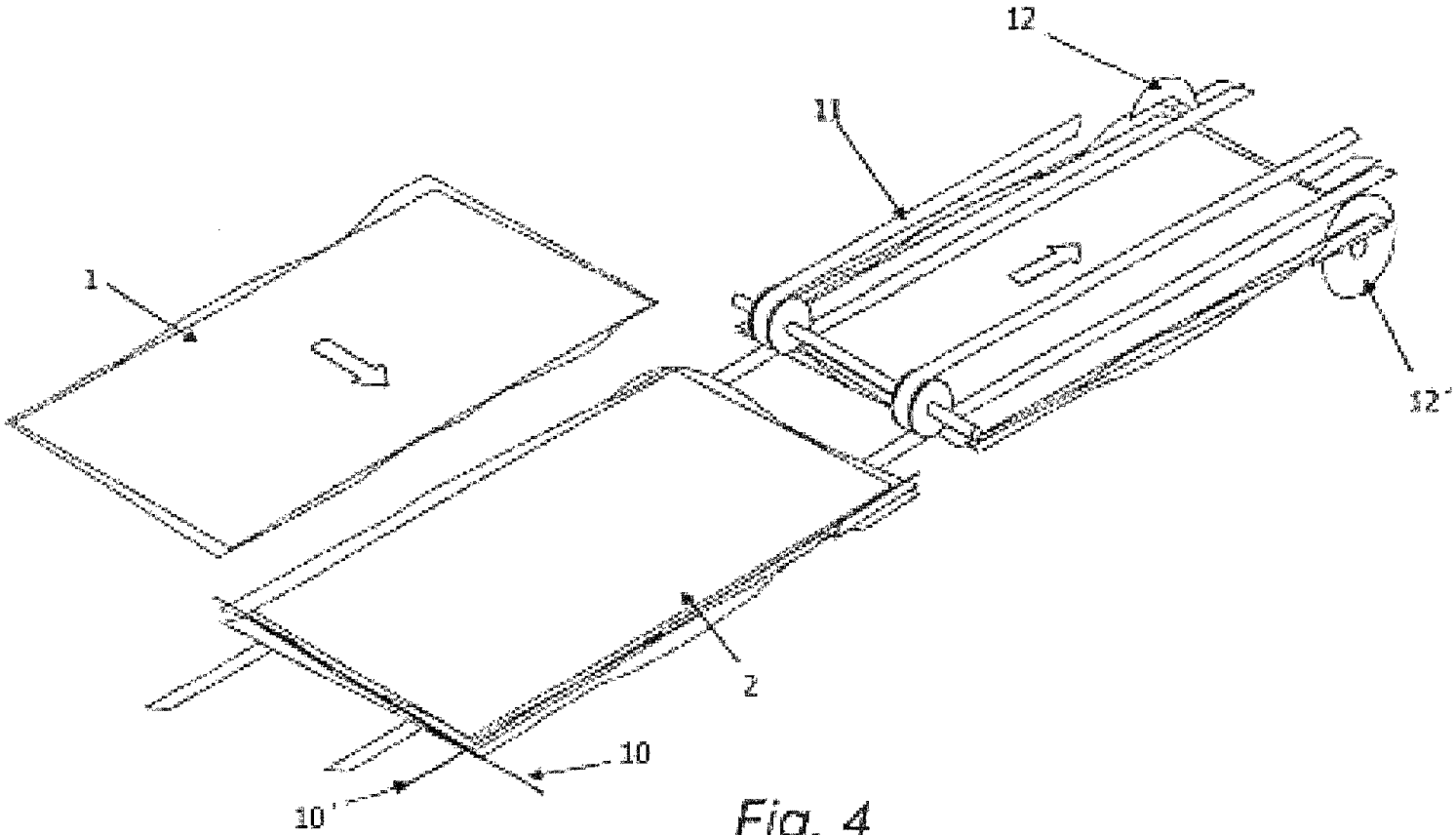
FIG. 4 shows a veneer assembly trimming operation in a schematic view of principle.

FIG. 3 illustrates a second lay-up practice of the invention, in which the veneers are positioned automatically. In this embodiment, the production line is provided with a camera 8 placed upstream of a lay-up station, said camera checking the dimensions of a veneer and calculating whether it is sufficient for a panel, and concluding which is the optimal position to set it. A veneer with insufficient dimensions is rejected from the assembly. When a veneer conveyed by belts arrives at the lay-up station, it will be captured by grippers 5, 5' whose position at the end of support brackets 6, 6' is precisely known and, at the same time, a second camera 7 is used for checking a true position of the veneer, followed by calculating an alignment position for the veneer. This enables determining precisely the position of a veneer in the coordinate system of a robot. After this, the veneer is conveyed to a desired lay-up point and lowered down. In the presented embodiment, the veneer is lowered on top of a panel 9 by means of the support brackets 6, 6'. Then, the panel 9 is moved away from under the veneer, whereby one end of the veneer descends and attaches to the stack with adhesive. This is followed by withdrawing the support brackets 6, 6'.

One alternative to the foregoing mode of operation is such that, as a veneer conveyed by belts arrives at a lay-up station, said veneer can be dropped onto a panel tablet traveling forward at a speed equal to that of the veneer, or onto some other veneer-receiving carrier. After the tablet has advanced across a halfway point, the grippers are able to take hold of the veneer, followed by performing necessary straightening operations, and then the tablet or another carrier can be pulled away from under for taking up the next veneer.

Once completed, the veneer assembly is conveyed for a trimming operation e.g. to an edge sawing apparatus, which is used for sawing the veneer assembly to provide it with an edge consistent with a virtual alignment edge and a desired amount of tolerance. One alignment edge 10' is preferably the edge which is leading in the advancing direction of a veneer upon its arrival at the lay-up station, and a second alignment edge 10 is the edge perpendicular thereto. From the lay-up station, the veneer assemblies depart preferably in a direction perpendicular to the original advancing direction, such that the alignment edge 10' lies in a parallel relationship with the veneer assembly's advancing direction and can be sawn without stopping the veneer assembly. Preferably, the edge opposite to the alignment edge is also sawn at the same time by driving the veneer assembly across saw blades 12', 12 set at a desired crosswise distance from each other. The short sides perpendicular to the alignment edge are trimmed in such a way that the conveyor can be stopped e.g. on the basis of a pulse sensor reading, or such sides can be trimmed while the action is going on by using a so-called flying saw or a saw which advances in the same direction as the veneer assembly at the same speed while having its blade advancing across the veneer assembly. During the trimming operation, the veneer assembly is held e.g. by a belt 11.

Figure 5:
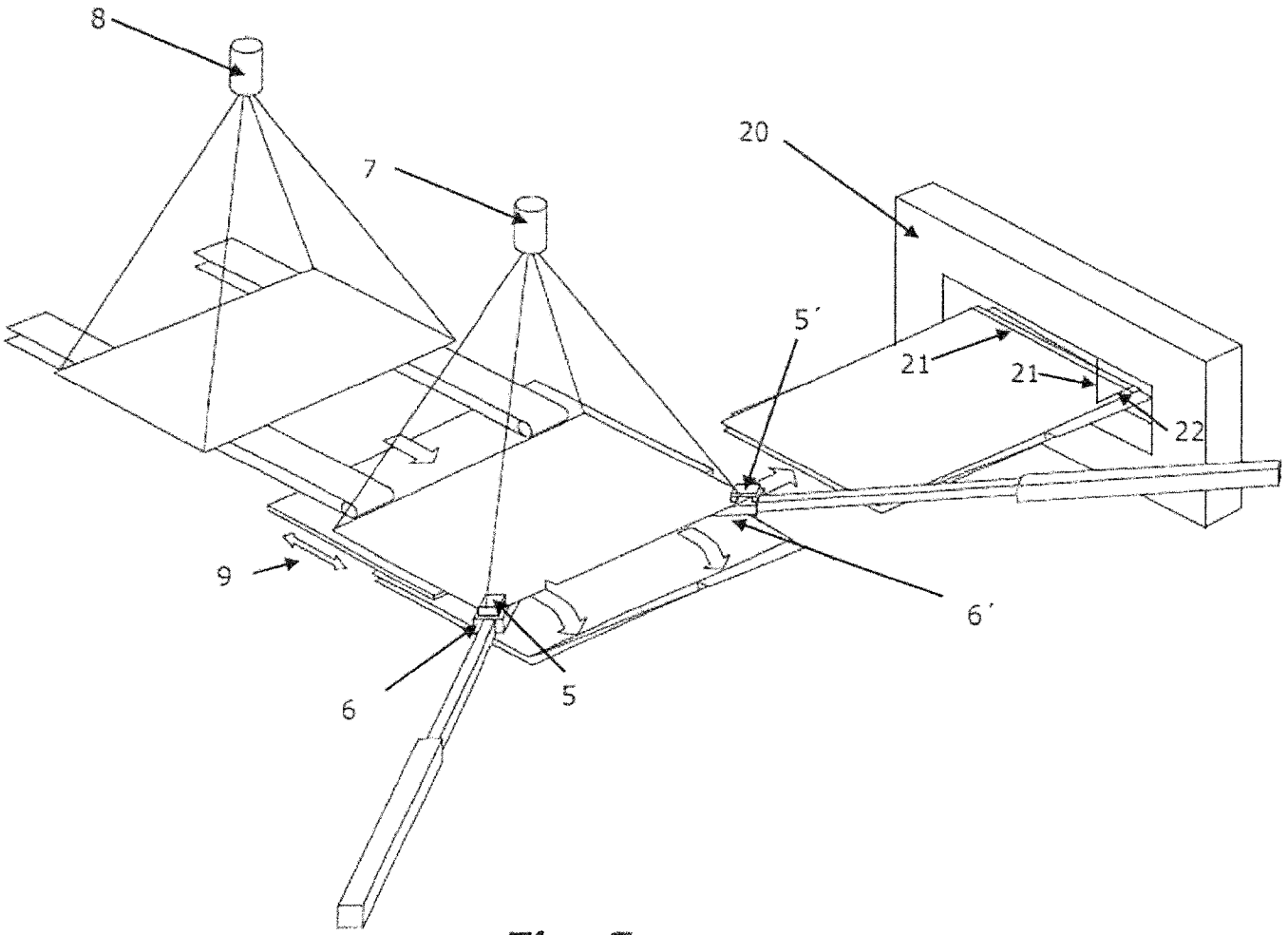
FIG. 5 shows in a schematic view an arrangement for mechanically marking the virtual alignment edges by making alignment holes according to the present invention.

A virtual edge can also be marked with some prior known method, which marking remains fixed in various operations of the process. Such a method may comprise e.g. marking a virtual edge by means of a perforation or another mechanical indication (see, e.g., element 21 or 22 in FIG. 5). The perforation can be made e.g. by drilling or punching a required number of marking holes or recesses in a veneer sheet. The marking can also be made e.g. with an ink jet printer or some other instrument (see, e.g., element 20 in FIG. 5) producing a permanent imprint.

That which is claimed:

1. A method for the optimal positioning of veneer sheets at a lay-up station, wherein the veneer sheets are attached for a veneer assembly composed of veneer sheets glued on top of each other, wherein the method comprises:

determining an optimal position for each veneer sheet in the veneer assembly;

determining perpendicularly-arranged virtual alignment edges individually for each veneer sheet, with respect to the optimal position thereof, at least the virtual alignment edges being determined separately of the real veneer edges of each individual veneer sheet, without the virtual alignment edges extending outwardly of the respective real veneer edges; and positioning the veneer sheets with respect to each other such that the veneer sheets are aligned in accordance with the respective virtual alignment edges thereof, during lay-up of the veneer sheets to form the veneer assembly.

2. A method as set forth in claim 1, wherein determining the perpendicularly-arranged virtual alignment edges for each veneer sheet further comprises:

determining the perpendicularly-arranged virtual alignment edges for each veneer sheet and a true location of the veneer sheet at a lay-up station on the basis of a camera image; and positioning the veneer sheets in accordance with the virtual alignment edges and with respect to the optimal position to form the veneer assembly by means of positioning elements in response to obtained image data.

3. A method as set forth in claim 1, wherein determining the perpendicularly-arranged virtual alignment edges for each veneer sheet further comprises:

determining the perpendicularly-arranged virtual alignment edges for each veneer sheet and a true location of the veneer sheet at a lay-up station on the basis of a camera image; and positioning the veneer sheets in accordance with the virtual alignment edges and with respect to the optimal position to form the veneer assembly by means of positioning elements in response to obtained true location data.

4. A method as set forth in claim 1, further comprising trimming the veneer assembly, after laying up the veneer sheets, according to at least one of the virtual alignment edges, such that the at least one of the virtual alignment edges becomes a real alignment edge of the veneer assembly.

5. A method as set forth in claim 4, further comprising trimming all edges of the veneer assembly after laying up the veneer sheets.

6. A method as set forth in claim 1, further comprising mechanically marking the virtual alignment edges by making alignment holes or indications in each respective veneer sheet.

* * * * *